US005856625A

United States Patent [19]

Saunders et al.

[11] Patent Number: 5,856,625

[45] Date of Patent: Jan. 5, 1999

[54] STAINLESS STEEL POWDERS AND ARTICLES PRODUCED THEREFROM BY POWDER METALLURGY

[75] Inventors: John Saunders, Ayelsford; Paul Dudfield Nurthen, Tonbridge; Nigel Craig Trilk, Redhill; Peter Ronald Brewin, Sevenoaks; John Vivian Wood, Bolnhurst, all of England

[73] Assignee: Powdrex Limited, Kent, England

[21] Appl. No.: 913,230

[22] PCT Filed: Mar. 7, 1996

[86] PCT No.: PCT/GB96/00532

§ 371 Date: Dec. 4, 1997

§ 102(e) Date: Dec. 4, 1997

[87] PCT Pub. No.: WO96/28580

PCT Pub. Date: Sep. 19, 1996

[30] Foreign Application Priority Data

Mar. 10, 1995 [GB] United Kingdom ..... 9504931
Apr. 1, 1995 [GB] United Kingdom ..... 9506771

[51] Int. Cl.[6] ..... C22C 33/00

[52] U.S. Cl. ..... 75/236; 75/246; 75/252; 419/31; 419/38

[58] Field of Search ..... 75/246, 252, 236; 419/31, 38

[56] References Cited

U.S. PATENT DOCUMENTS 3,993,445 11/1976 Reen .
4,059,440 11/1977 Takemura et al. .
4,581,202 4/1986 Kudo et al. ..... 419/42
4,765,836 8/1988 Hauser et al. ..... 75/241
4,808,226 2/1989 Adam ..... 75/246

FOREIGN PATENT DOCUMENTS

A 0 130 177 1/1985 European Pat. Off. .
A 0 275 475 7/1988 European Pat. Off. .
A 40 40 030 6/1991 Germany .

OTHER PUBLICATIONS

Matsumoto, Shuji et al., "Iron alloy for rotary compressor blades" XP002006203 abstract, Chemical Abstracts, vol. 108, No. 4, Jan. 25, 1988, Columbus, Ohio, US. abstract No. 25459 and Japanese Publication No. A 62 149 846.

*Primary Examiner*—Ngoclan Mai
*Attorney, Agent, or Firm*—Lahive & Cockfield, LLP

[57] ABSTRACT

Articles produced by a powder metallurgy process involving forming of a shape by compaction followed by sintering without the application of external pressure from a stainless steel alloy powder produced by rapid atomization followed by an annealing treatment, which powder consists essentially of in weight percent, chromium 14–30, molybdenum 1 to 5, vanadium 0 to 5, tungsten 0 to 6, silicon 0 to 1.5, carbon minimum as specified below to one fifth chromium content minus 2, other strong carbide forming elements such as Nb, Ta, Ti totaling together 0 to 5, the total of Mo, V and W being at least 3, the balance being iron including incidental impurities; the alloy powder (including any addition of free graphite powder mixed therewith before sintering having a sufficient carbon content to form carbides with all the Mo, V, W and other strong carbide forming elements present; the articles consisting of distribution of carbides embedded in a substantially ferritic matrix containing at least 12% by weight of chromium in solution, and which articles do not require further heat treatment.

14 Claims, No Drawings

STAINLESS STEEL POWDERS AND ARTICLES PRODUCED THEREFROM BY POWDER METALLURGY

BACKGROUND OF THE INVENTION

This invention relates to atomised high alloy powders of compositions which when used to manufacture sintered articles, provide metal articles having a good corrosion resistance, compared with components produced from conventional stainless steel powders, and in addition having exceptionally good wear resistance.

Stainless steels can be classified in a variety of ways. However, the key differences in properties are determined by the type of matrix created in the steel after processing and possibly, heat treatment. Alloys based around predominantly ferritic, austenitic, and martensitic matrices are all in common use. In addition, duplex steels, typically having a matrix containing 50/50 mix of austenite and ferrite, are available.

Martensitic stainless steels are essentially ferrous alloys containing chromium and carbon. They can be made fairly hard and wear resistant by development of a martensitic matrix, sometimes strengthened by precipitates, but are generally only resistant to corrosion in relatively mild environments due to their low chromium contents.

Austenitic stainless steels are ferrous based alloys containing moderate additions of chromium but with very little carbon. In addition liberal amounts of austenite stabilising elements, such as nickel, manganese and nitrogen, are added. The common austenitic grades contain a minimum of 6% nickel. In general, these alloys achieve better corrosion resistance than the martensitic grades. This is due primarily to their higher chromium contents. However, powder metallurgy produced austenitic stainless steels are susceptible to fairly severe crevice type corrosion at certain sintered densities. In addition since the austenitic grades are generally soft they cannot achieve good wear resistance.

Conventional ferritic stainless steels are ferrous based alloys containing primarily large additions of chromium with low concentrations of carbon and nickel. These alloys show excellent corrosion resistance especially at the higher chromium levels (superferritic) with a reduced tendency to the crevice type corrosion found in austenitic stainless steels. However, the ferritic type matrix is extremely soft and has a poor work hardening response. Consequently these alloys develop poor wear characteristics.

In summary, austenitic grades provide good corrosion resistance but have a tendency towards crevice type corrosion in powder metallurgy produced components. In addition, these materials tend to be more highly alloyed than ferritic grades, with a similar level of corrosion performance, due to the requirement for large additions of nickel to stabilise the austenitic matrix. Martensitic grades provide good wear resistance but only moderate corrosion resistance. Finally ferritic grades offer potentially excellent corrosion resistance but poor wear resistance due to the poor mechanical properties of ferrite.

In general it has been the practice when producing conventional stainless steel materials for applications requiring good corrosion resistance and ease of fabrication to avoid the use of chromium in large quantities due to the fact that a fully austenitic matrix cannot be maintained without large nickel or manganese contents also being present. In the practice of this invention no nickel or manganese is required to provide a material with excellent corrosion properties and powder metallurgy processing avoids any problems with ease of fabrication. Furthermore, in conventional austenitic or ferritic stainless steels the addition of large quantities of carbon is also to be avoided due to a reduction in corrosion resistance by the well known phenomenon of sensitisation (reduction of the matrix chromium content in the vicinity of the grain boundary by carbide precipitation at the grain boundaries).

PRIOR ART

A number of workers in this field have previously investigated the addition of high chromium levels to alloys containing various other elements. (U.S. Pat. No. 3,993,445) teaches that when high chromium levels (12–30 wt %) are used to produce a ferritic stainless steel densities of less than 80% of full density can provide good corrosion resistance. However, the alloys disclosed in that patent have no more than 0.15 wt % of carbon.

Other workers in the field for example U.S. Pat. No. 4,765,836, EP-A-0348380 and WO/8604841 have disclosed the use of powders containing high chromium, high carbon, and strong carbide formers, and claim good corrosion resistance with good wear resistance. However, these patents teach the use of these powdered materials for hot isostatic pressing, forging, and extrusion. These processes all require the application of high pressures during heating in order to produce a nominally 100% dense material which is then further heat treated in order to produce the required properties. Densification necessarily involves deformation so an article of dimensional stability is not achieved.

Specifically U.S. Pat. No. 4,765,836 teaches that the alloy composition disclosed in that patent produces a martensitic structure when heat treated.

European patent 0 348 380 also teaches the use of high chromium materials with carbide forming alloying elements matched by the presence of sufficient carbon to form carbides. However, this patent includes the application of pressure during heating, and material homogeneity due to hot working during or after full densification. The only example describes a six-fold degree of deformation during forging, following by further heat treatments.

PCT WO/8604841 also discloses hot isostatic pressing of high chromium materials. Furthermore, the alloy compositions do not contain strong carbide formers. The composition allows the addition of up to 2.3 wt % nickel.

Finally, U.S. Pat. No. 4,808,226 discloses materials with chromium contents up to 14 wt % consolidated by applying pressure during the heating stage. Furthermore a specific powder size range of 75–105 microns is employed. This size range is used in order to produce a metastable austenitic powder.

SUMMARY OF THE INVENTION

A primary objective of the invention is to provide articles from stainless steel alloy powders which may include the addition of free graphite powder, and to provide powder suitable for making such articles, which articles have a combination of high wear resistance and good corrosion resistance and preferably are produced to a required dimension without further heat treatment or thermo mechanical working giving rise to significant deformation and a change in dimensions. By further heat treatments we mean such heat treatments as would lead to a change in metallurgical structure.

We have found that the main objects can be achieved by cold pressing and sintering powder containing large quantities of chromium (in excess of 14 wt %) and a controlled quantity of carbon and strong carbide forming elements such as those found in high speed steels (for example tungsten, molybdenum, vanadium) and others recognised as forming stable carbides (for example Nb, Ta, Ti etc), produced by atomisation and subsequently annealed for long periods in order to produce a stable ferrite matrix containing a distribution of carbides to produce steel articles containing large quantities of carbide precipitates embedded in a stable ferritic matrix. The compositions contain no nickel or manganese except as impurities.

In one aspect the present invention provides articles produced by a powder metallurgy process involving forming of a shape by compaction followed by sintering without the application of external pressure from a stainless steel alloy powder consisting essentially of, in weight %, chromium 14 to 30, molybdenum 1 to 5, vanadium 0 to 5, tungsten 0 to 6, silicon 0 to 1.5, carbon 0 to (one fifth chromium content minus 2), other strong carbide forming elements (eg Nb, Ta, Ti etc) totalling together 0 to 5 and if present, requiring additional carbon sufficient to form carbides therewith, the total of Mo, V and W being at least 3, the balance being iron including incidental impurities, the powder being produced by rapid atomisation followed by an annealing treatment, which powder may be mixed with an addition of free graphite powder, the articles consisting of a distribution of carbides embedded in a substantially ferritic matrix containing at least 12% by weight of chromium in solution, and which articles do not require further heat treatment.

Articles produced in this way retain the shape of the original pressed article. Depending on the sintering conditions a degree of uniform shrinkage may occur giving rise to changes in density but this is achieved without the application of external pressure. This results in shaped articles which may be used in a final application with a minimum of final machining.

In another aspect the invention provides a method of producing articles by a powder metallurgy process involving forming a shape by compaction followed by sintering without the application of external pressure or deformation using a stainless steel alloy powder which has been produced by rapid atomisation followed by an annealing treatment, which alloy powder may be mixed with an addition of free graphite powder; the alloy powder consisting essentially of, in weight percent, chromium 14 to 30, molybdenum 1 to 5, vanadium 0 to 5, tungsten 0 to 6, silicon 0 to 1.5, carbon as specified below to (⅕ chromium content minus 2), other strong carbide forming elements (eg Nb, Ta, Ti) totalling together 0 to 5, the total of Mo, V and W being at least 3, the balance being iron including incidental impurities, the alloy powder including any addition of free graphite powder mixed therewith before sintering having a sufficient carbon content to form carbides with all the Mo, V, W and other strong carbide forming elements present;

In a further aspect the invention provides an alloy powder having a composition consisting essentially of, in weight percent, chromium 14 to 30, molybdenum 1 to 5, vanadium 0 to 5, tungsten 0 to 6, silicon 0 to 1.5, carbon as specified below to (one fifth chromium content minus 2), other strong carbide forming elements (eg Nb, Ta, Ti) totalling together 0 to 5, the total of Mo, V and W being at least 3, balance iron including incidental impurities;

the powder including sufficient carbon to form carbides with all the Mo, V, W and other strong carbide forming elements present;

the powder being produced by rapid atomisation followed by an annealing treatment such that the powder has a substantially ferritic matrix containing at least 12% of chromium in solution and a dispersion of carbides.

Where the minimum and maximum carbon contents given above conflict because for certain alloys minium would exceed maximum, the maximum overides the minimum, so as to leave some strong carbide forming elements uncombined.

In a still further aspect the invention provides an alloy powder having a composition consisting essentially of, in weight percent, chromium 20 to 28, molybdenum 2 to 3, vanadium 1.5 to 2.5, tungsten 2.5 to 3.5, silicon 0.8 to 1.5, carbon 0.555 to 2, other strong carbide forming elements (eg Nb, Ta, Ti) totalling together 0 to 5 and if present, requiring additional carbons sufficient to form carbides therewith, balance iron including incidental impurities, the powder being formed by rapid atomisation followed by an annealing treatment such that the powder contains at least 12% of chromium in solution and a dispersion of carbides.

The minimum and maximum carbon content of the articles and alloy powder is preferably $C_{min}=(\%V\times0.24)+(2\times\%Mo+\%W)\times0.03+(\%Nb\times0.13)+(\%Ti\times0.25)+(\%Ta\times0.066)$ $C_{max}=C_{min}+0.3+(\%Cr-12)\times0.06$ In the present invention wear resistance is provided by creating a dispersion of a variety of carbide types in a ferritic matrix. No additional heat treatment is required and martensite is not produced even at high cooling rates due to the stability of the ferritic matrix.

On investigating the properties of articles produced in this way (with or without added graphite as appropriate) it was found that they had a corrosion resistance similar to that of conventional powder produced austenitic materials, for example 316L, but had a wear resistance more than 300% greater.

In our preferred process the powder is produced in such a way that the particles consist of a stable ferritic matrix containing a distribution of carbides. The powder is initially formed by melting the required composition, with the exception of some of the carbon which may be added during the annealing stage and allowed to diffuse into the powder particles, and disintegrating the melt by atomisation processes with high cooling rates, such as water or gas atomisation. Large particles (for example greater than 1000 microns) are removed by sieving. The high cooling rates ensure that only fine scale segregation of alloying elements occurs, and the divided nature of the powder ensures that microsegregation only exists on a scale smaller than the particle size. The nature of the powder production should also be such that each particle is nearly of the same composition. The powder, with or without the addition of extra carbon as required to achieve the desired annealed powder composition, is then treated at temperatures of between 700° C. to 1050° C. for a period of between 12 and 100 hours under vacuum. During this annealing process any blended carbon diffuses into the powder particles, becoming indistinguishable from the prealloyed carbon and the matrix of all the powder particles converts to stable ferrite containing a dispersion of carbides. In addition the oxygen content on the surface of the powder is reduced to levels below 1200 ppm which provides a powder which sinters well and results in a low oxygen content final article. Such process is known in the production of high speed steel powders. However, whereas with high speed steel powders articles subsequently produced by powder metallurgy routes can be heat treated by converting the ferrite to austenite and then martensite by quenching and tempering, the ferrite matrix produced in materials of the current invention cannot be heat treated due to the stability of the ferrite matrix produced.

The composition of the annealed alloy powders is controlled so that when an appropriate amount of carbon is present in the final article (such carbon being prealloyed or blended as free graphite prior to pressing) discrete carbides are formed with vanadium, tungsten, molybdenum, chromium, and other carbide formers if they are present, but at least 12 wt % of chromium remains in the solution in the matrix, the remaining carbon in solution being limited so as to maintain a substantially ferritic matrix. In this way sensitisation is avoided and a corrosion resistant, wear resistant material results. The exact amount of carbon in the powder before consolidation depends on the alloying elements, which take up different amounts of carbon to form the carbides. The essential is that there is just sufficient carbon to form a critical dispersion of discrete, abrasion resistant carbides whilst maintaining a substantially ferritic matrix.

An advantage of the alloy powders of this invention is that they may be blended with cheaper conventional stainless steel powders prior to compaction and processing into articles. This aspect produces an article which is a composite of hard wearing particles and the softer conventional powder which enhances the wear resistance of conventional stainless steel article. The nature of both powders in the mix confers excellent corrosion resistance on the composite article.

The final carbon content in the article may be achieved by blending free graphite, if required, into the powder prior to pressing. Where the additional carbide forming elements are contained in the alloy powder additional carbon is present (preferably in stoichiometric amounts which can be calculated by reference to the type of carbide formed and the ratio of the atomic weights) to compensate for the formation of the additional carbides. Such carbon calculations are well known to those skilled in the art, and are as follows:

0.2 wt % per 1 wt % vanadium as $V_4C_3$ 0.033 wt % per wt % tungsten 0.063 wt % per wt % molybdenum 0.06 wt % per wt % chromium as $Cr_{23}C_6$ For vanadium in the form of VC, tantalum, and titanium the stoichiometry requires 0.24 wt % of carbon per 1 wt % vanadium, 0.25% carbon per 1% wt titanium and 0.66 wt % carbon per 1 wt % tantalum.

The minimum carbon required in the present invention is the minimum required by the carbide forming elements with the exception of chromium which will remain in the matrix if there is insufficient carbon for chromium carbide formation after the formation of other carbides, and can be calculated from the following formula:

$$C_{min}=(\%V\times0.24)+(2\times\%Mo+W)\times0.03+(\%Nb\times0.13)+(\%Ti\times0.25)+(\%Ta\times0.066)$$

If other carbide forming elements are present then additional carbon is required according to the principles outlined above.

The maximum carbon allowable is the minimum carbon defined above, plus 0.3 wt %, plus the carbon required to form chromium carbide with all but 12% (or possibly 13%) of the chromium. This can be described by the following equation:

$$C_{max}=C_{min}+0.3+(\%Cr-12\ [\text{optionally } 13])\times0.06$$

This allows for the formation of some chromium carbide while leaving 12% (or 13%) chromium in solution. The addition of a further 0.3 wt % carbon allows for non stoichiometry and other natural changes in the balance between the carbide forming element and the carbon.

The final powder mix is then compacted and sintered by subjecting the shapes produced to temperatures in the range 1050°–1350° C., and preferably between 1150° and 1250° C., for periods between 10 minutes and three hours. The compaction and heating should be carried out sequentially with no external pressure being applied during the sintering step. After these treatments the compacts are allowed to cool at rates of between 10–200 degrees C. per minute. It is important that the process used does not decarburise the surface of the article as this adversely affects the dispersion of carbides.

The density of the articles produced depends on the composition of the alloy, whether or not it is mixed with other powders, and the processing route. In particular, a degree of uniform shrinkage may occur, depending on the sintering conditions, giving rise to changes in density. The density will have a significant effect on all the properties. However, within the density range associated with any given process route, encompassing the thermal cycles quoted above, the wear properties of articles produced are relatively unaffected by processing conditions (with the exception of decarburising) as they are determined by the precipitation of the carbide dispersion.

Within the density range associated with a given process route corrosion properties are more significantly affected by the detail of the process conditions. It is well known that the corrosion properties of conventional powder metallurgy stainless steels can be significantly affected by various conditions. For example, high dew point sintering atmospheres, and the reaction of the article surface with quenching gasses. In this respect the powders of this invention are no different to conventional powders, exhibit similar effects, and have corrosion properties similar, and normally better than, powder metallurgy produced austenitic stainless steels.

EXAMPLES OF THE INVENTION

To demonstrate the invention, alloy powders with compositions according to the invention were prepared and samples made from them as described below. Samples were also prepared from conventional stainless steel powders for comparison. The comparison powders comprised 316L, an austenitic stainless steel, and 410L a martensitic stainless steel. The compositions of the powders are laid out in Table 1.

TABLE 1

| | Chemical composition of experimental and conventional alloys | | | | | | |
|---|---|---|---|---|---|---|---|
| Identity | C | Cr | Mo | V | W | Si | Ni |
| HC13 | 0.55 | 12.78 | 2.63 | 2.16 | 3.44 | 0.84 | — |
| HC18 | 0.56 | 17.64 | 2.60 | 2.24 | 3.38 | 0.82 | — |
| HC23 | 0.60 | 24.38 | 2.54 | 2.07 | 3.70 | 1.32 | — |
| HC28 | 0.65 | 27.98 | 2.49 | 1.57 | 3.57 | 0.91 | — |
| 316L | 0.025 | 16.1 | 2.47 | — | — | 0.78 | 12.6 |
| 410L | 0.017 | 12.4 | — | — | — | 0.47 | — |

All compositions in weight percent, balance iron.

Alloys 316L and 410L were obtained from a commercial source. The remaining experimental alloys were prepared by producing melts of the desired composition and water atomising. The powder was screened to −100 mesh and annealed using conventional annealing cycles to allow the powder to be compacted using powder metallurgy compaction presses.

After annealing, the experimental powders were blended with various amounts of carbon to provide final carbon levels in the sintered articles as stated in Tables 2 and 3. In one instance a mix of 20% HC23 and 80% 316L was prepared.

The blends of powder were pressed using conventional powder metallurgy presses and tooling to produce compacts with various densities. The samples prepared were cylinders 6 mm in diameter and 16 mm long for pin and disc wear testing and rectangular blocks 78 mm×10 mm×6.5 mm for corrosion testing.

The samples were sintered at temperatures between 1100 and 1250 degrees centigrade for between 20 minutes and 1 hour in a vacuum, in a mixture of 50% nitrogen 50% hydrogen gas, or in pure hydrogen gas. Cooling after sintering was at a rate between 10 and 20 degrees centigrade per minute.

Comparative Wear Testing

Cylinders for wear testing were sintered for 30 minutes under vacuum and were cooled at an estimated rate of 20 degrees centigrade per minute.

Wear testing was carried out by pressing the circular end of a wear test pin onto a rotating disc of 52100 steel hardened to 60/62 HRc with a load of 10 kg. The disc was rotated at a variety of speeds and the relative motion of the pin and disc calculated.

In this type of test, low rates of pin wear are found at low speeds but as the speed increases the rate of wear undergoes a change to rapid wear at a characteristic speed known as the T1 transition. The higher the T1 transition speed the better is the wear resistance of the test alloy.

The following T1 transition speeds were determined

TABLE 2

T1 Transition speeds for various sintered alloys

| Powder | Final carbon weight % | Sintered Density g/cc | T1 transition m/s |
|---|---|---|---|
| 316L | 0.015 | 6.95 | <0.5 |
| 316L + 20% HC23 | 0.12 | 6.7 | 0.75 |
| 410 | 0.15 | 6.82 | 1.35 |
| HC23 | 1.60 | 6.7 | 3.05 |
| HC23 | 2.09 | 7.0 | 3.4 |

Comparative Corrosion Resistance

Rectangular blocks for comparative corrosion testing were prepared from the same powder blends as those used in the wear testing above.

The samples were sintered at a temperature of 1140 degrees centigrade in a 50% nitrogen 50% hydrogen atmosphere for a period of 25 minutes and were subsequently cooled at an estimated rate of 13.5 degrees centigrade per minute. In this experiment the sintered density of the alloys 316L, 316L+20%HC23, and 410 was around 6.6 g/cc and the density of the HC23 alloys was about 6.1 g/cc.

The samples were tested for relative pitting corrosion resistance using the ferroxyl test described in Metal Powder Report, April 1994, pp 42–46. In this test the degree of corrosion that has occurred can be determined by the amount of Turnbull's blue dye that appears in the test solution.

A 0.2% sodium chloride solution was used and the samples left submerged in the corrosion medium for a period of 24 hours at 20 degrees centigrade. At the end of this period the amount of dye present was determined subjectively and the materials ranked in terms of their corrosion resistance as follows:

Most dye, worst corrosion resistance
410
HC23 2.1 wt % carbon
316L & 316L+20%HC23
HC23 1.6 wt % carbon
Least dye, best corrosion resistance Corrosion Resistance at Various Carbon and Chromium Compositions In order to test the effect of chromium and carbon content on corrosion resistance. The alloys HC13, HC18, HC23 and HC28 were tested at a variety of final carbon contents.

Rectangular samples were pressed and then sintered in a hydrogen atmosphere for up to 60 minutes. A range of sintering temperatures from 1100 to 1230 degrees centigrade was used to produce a density of around 6.1 g/cc in all samples. The samples were then cooled at an estimated rate of between 10 and 15 degrees centigrade per minute.

At high carbon contents, relative to the chromium content, the corrosion resistance of the alloys deteriorates rapidly due to the formation of significant quantities of austenite. This can be detected within 10 minutes immersion in the ferroxyl test solution. If the sample was seen to corrode within 30 minutes then the corrosion resistance was defined as poor. If no corrosion was detected then corrosion rates were found to remain slow for many hours and the corrosion resistance was defined as good.

The following results were obtained:

TABLE 3

Corrosion resistance as a function of chromium and carbon content

| | Final sintered carbon level weight percent | | | | | |
|---|---|---|---|---|---|---|
| Alloy | 0.59 | 1.09 | 1.59 | 2.09 | 2.59 | 3.09 |
| HC13 | Poor | NT | NT | NT | NT | NT |
| HC18 | Good | Poor | Poor | NT | NT | NT |
| HC23 | Good | Good | Good | Good | Poor | Poor |
| HC28 | Good | Good | Good | Good | Good | Poor |

Good denotes insignificant corrosion in 10 minutes
Poor denotes significant corrosion in 10 minutes
NT denotes that this combination was not tested

We claim:

1. An alloy powder comprising, in weight percent, chromium 14 to 30, molybdenum 1 to 5, vanadium 0 to 5, tungsten 0 to 6, silicon 0 to 1.5, carbon according to the formula set forth below, a strong carbide forming element 0 to 5, the total of Mo, V and W being at least 3, balance iron including incidental impurities;

the alloy powder together with any addition of free graphite powder mixed therewith having a minimum and maximum carbon content according to $C_{min}=(\%V\times 0.24)+(2\times\%Mo+\%W)\times 0.03+(\%Nb\times 0.13)+(\%Ti\times 0.25)+(\%Ta\times 0.066)$, and $C_{max}=C_{min}+0.3+(\%Cr-12)\times 0.06$, such that the powder includes sufficient carbon to form carbides with all the Mo, V, W and the strong carbide forming element present;

the powder being produced by rapid atomisation followed by an annealing treatment such that the powder has a substantially ferritic matrix containing at least 12% of chromium in solution and a dispersion of carbides.

2. An alloy powder comprising, in weight percent, chromium 20 to 28, molybdenum 2 to 3, vanadium 1.5 to 2.5, tungsten 2.5 to 3.5, silicon 0.8 to 1.5, carbon 0.555 to 2, a strong carbide forming element 0 to 5, and if present, requiring additional carbons sufficient to form carbides therewith so as to give $C_{min}=(\%V\times 0.24)+(2\times\%Mo+\%W)\times 0.03+(\%Nb\times 0.13)+(\%Ti\times 0.25)+(\%Ta\times 0.066)$, and $C_{max}=C_{min}+0.3+(\%Cr-12)\times 0.06$, balance iron including incidental impurities, the powder being formed by rapid atomisation followed by an annealing treatment such that the powder contains at least 12% of chromium in solution and a dispersion of carbides.

3. An alloy powder according to claim 2 having a stable substantially fully ferritic matrix.

4. An article produced from an alloy powder according to claim 1, formed by a powder metallurgy process comprising forming a shape from the powder by compaction followed by sintering without the application of external pressure.

5. The article of claim 4, wherein said alloy powder is mixed with a conventional stainless steel powder.

6. An article produced from an alloy powder according to claim 2, formed by a powder metallurgy process comprising forming a shape from the powder by compaction followed by sintering without the application of external pressure.

7. The article of claim 6, wherein said alloy powder is mixed with a conventional stainless steel powder.

8. A method of producing articles by a powder metallurgy process comprising forming a shape by compaction of a powder followed by sintering without the application of external pressure or deformation, in which the powder is a stainless steel alloy powder which has been produced by rapid atomisation followed by an annealing treatment, the alloy powder comprising, in weight percent, chromium 14 to 30, molybdenum 1 to 5, vanadium 0 to 5, tungsten 0 to 6, silicon 0 to 1.5, carbon according to the formula set forth below, a strong carbide forming element 0 to 5, wherein the total of Mo, V and W being at least 3, the balance being iron including incidental impurities, the alloy powder together with any addition of free graphite powder mixed therewith having a minimum and maximum carbon content according to $C_{min}=(\%V\times 0.24)+(2\times\%Mo+\%W)\times 0.03+(\%Nb\times 0.13)+(\%Ti\times 0.25)+(\%Ta\times 0.066)$, and $C_{max}=C_{min}+0.3+(\%Cr-12)\times 0.06$, such that the powder has a sufficient carbon content to form carbides with all the Mo, V, W and other strong carbide forming elements present while leaving at least 12% chromium in solution in the matrix.

9. A method according to claim 8, further comprising the steps of sintering the article in the range 1050° C. to 1350° C. for a period of 10 minutes to three hours, and cooling the article at a rate in the range 10° C. to 200° C. per minute.

10. A method according to claim 8, further comprising the step of mixing the alloy powder with an additional free graphite powder.

11. A method according to claim 8, in which the annealing treatment comprises annealing under vacuum for 12 to 100 hours at a temperature in the range 700° C. to 1050° C.

12. An article produced by the method of claim 8, comprising an article consisting of a distribution of carbides embedded in a substantially ferritic matrix containing at least 12% by weight of chromium in solution, said article being free of the necessity for further heat treatment.

13. Articles according to claim 12, in which the alloy powder comprises, in weight percent, chromium 20 to 28, molybdenum 2 to 3, vanadium 1.5 to 2.5, tungsten 2.5 to 3.5, silicon 08 to 1.5, carbon 0.555 to 2, a strong carbide forming element 0 to 5, and balance iron including incidental impurities.

14. An alloy powder comprising, in weight percent, chromium 14 to 30, molybdenum 1 to 5, vanadium 0 to 5, tungsten 0 to 6, silicon 0 to 1.5, carbon $C_{min}$ to $C_{max}$, a strong carbide forming element 0 to 5, and a balance iron including incidental impurities, wherein $C_{min}=(\%V\times 0.24)+(2\times\%Mo+\%W)\times 0.03+(\%Nb\times 0.13)+(\%Ti\times 0.25)+(\%Ta\times 0.066)$ and $C_{max}=C_{min}+0.3+(\%Cr-12)\times 0.06$, such that the powder includes sufficient carbon to form carbides with all the Mo, V, W and strong carbide forming element present in the powder.

* * * * *